United States Patent [19]

Rudenauer et al.

[11] Patent Number: 4,901,643

[45] Date of Patent: Feb. 20, 1990

[54] PYROTECHNIC FUZE FOR PROJECTILES

[75] Inventors: Werner Rudenauer, Roth; Fritz Muller, Nuremberg; Norbert Liebl, Ruckersdorf; Dieter Kufner, Eckental; Joachim Furtmeyr, Erlangen, all of Fed. Rep. of Germany

[73] Assignee: Diehl GmbH & Co., Nürnberg, Fed. Rep. of Germany

[21] Appl. No.: 277,275

[22] Filed: Nov. 29, 1988

[30] Foreign Application Priority Data

Dec. 3, 1987 [DE] Fed. Rep. of Germany ..... 3740967

[51] Int. Cl.[4] ..... F42C 15/34

[52] U.S. Cl. ..... 102/256

[58] Field of Search ..... 102/303, 254–256

[56] References Cited

U.S. PATENT DOCUMENTS

| | | | |
|---|---|---|---|
| 4,029,016 | 6/1977 | Cole | 102/256 X |
| 4,030,418 | 6/1977 | Regber et al. | 102/254 X |
| 4,765,245 | 8/1988 | Berube et al. | 102/255 X |

FOREIGN PATENT DOCUMENTS 3333312 4/1985 Fed. Rep. of Germany .

*Primary Examiner*—Peter A. Nelson

*Attorney, Agent, or Firm*—Scully, Scott Murphy & Presser

[57] ABSTRACT

A pyrotechnic fuze for projectiles, rockets, bomblets and mines, which is basically a pyrotechnic self-destruct device, in which a triggering device for a pyrotechnic delay arrangement is arranged within a housing. The triggering device consists of an igniting composition and a delay composition, a detonator for the triggering of an explosive charge and a striker for the detonator, whereby the detonator is arranged in a transversely movable slider.

6 Claims, 4 Drawing Sheets

PYROTECHNIC FUZE FOR PROJECTILES

BACKGROUND OF THE INVENTION

1. Field of the Invention

The present invention relates to a pyrotechnic fuze for projectiles, rockets, bomblets and mines, which is basically a pyrotechnic self-destruct device, in which a triggering device for a pyrotechnic delay arrangement is arranged within a housing, the triggering device consisting of an igniting composition and a delay composition, a detonator for the triggering of an explosive charge and a striker for the detonator, whereby the detonator is arranged in a transversely movable slider.

2. Discussion of the Prior Art

In a fuze for bomblets pursuant to the disclosure of German Patent No. 33 33 312, in a transversely movable slider there is provided a detonator and an igniting composition for a spirally-shaped delay composition which is fixed to a housing. It has been recognized that malfunctions can occur with spirally-extending delay composition; for instance, the front of combustion for the pyrotechnic composition will terminate prematurely. In order to overcome this disadvantage, there are employed straight or, in effect, extended incendiary compositions. In this instance a, disadvantage for the delay composition arranged so as to extend transversely of the main axis of the ammunition, is the relatively short constructional length. The constructional length of the incendiary composition is dependent upon the caliber of the ammunition.

SUMMARY OF THE INVENTION

Accordingly, it is an object of the present invention to provide a pyrotechnic fuze which allows for the greatest possible constructional length for the delay composition at an assured triggering of the detonator.

The foregoing object is achieved in a pyrotechnic fuze, as described hereinabove, in that the housing includes a side or lateral opening for the slider which is outwardly displaceable beyond the external contour of the housing, and which slider contains the delay installation.

BRIEF DESCRIPTION OF THE DRAWINGS

Further features and modifications of the invention may now be readily ascertained from the following detailed description of an exemplary embodiment as described hereinabove, taken in conjunction with the accompanying drawings; in which.

DETAILED DESCRIPTION

Figure 1:
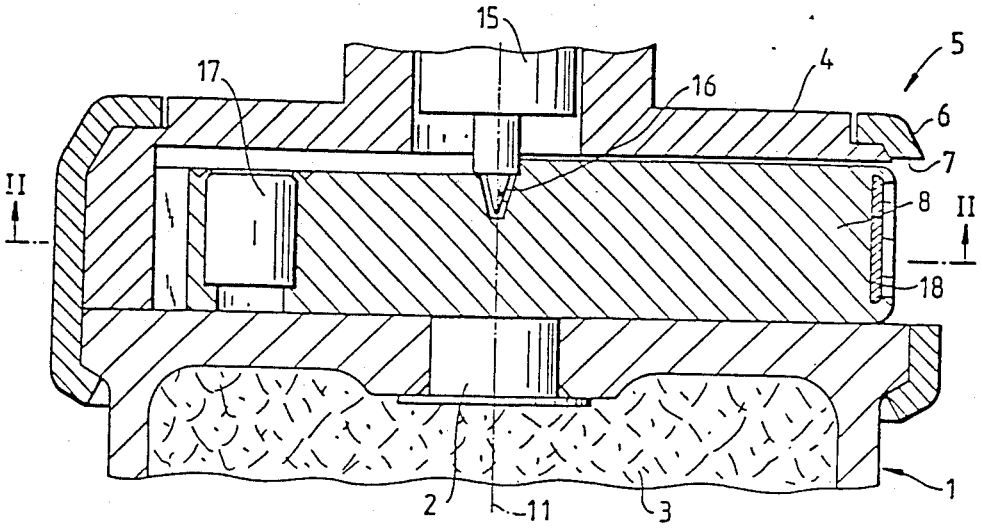
FIG. 1 illustrates a fragmentary sectional view of a pyrotechnic fuze for a bomblet.

A bomblet 1 which includes a transmission charge 2 and an explosive charge 3, supports a housing 4 for a pyrotechnic fuze 5. A casing or jacket 6 possessing an aperture 7 for a slider 8 connects the housing 4 with the bomblet 1.

A striker 15 engages into a bore 16 in the slider 8 in the secured position. A detonator 17 and a sheet metal plate 18 with a primer or firing pin 19 are flanged into the slider 8.

Figure 2:
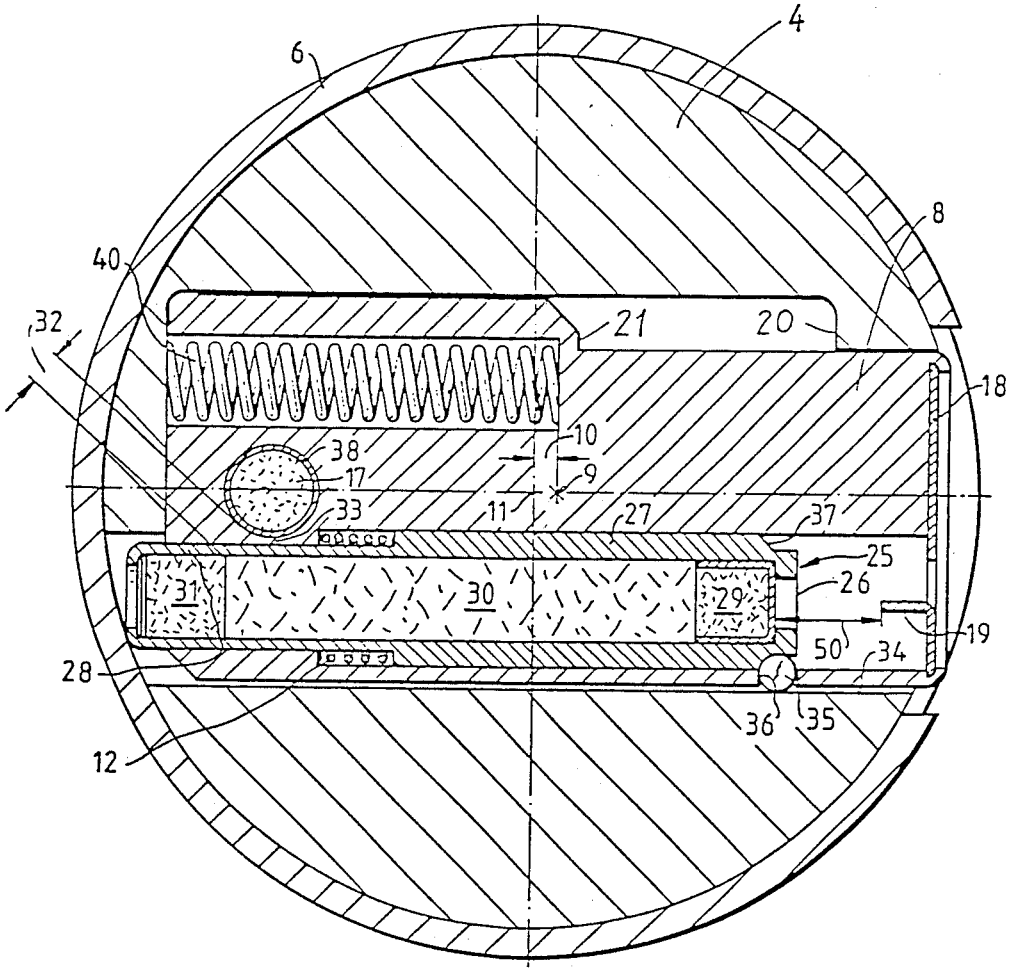
FIG. 2 illustrates a sectional view taken along line II—II in FIG. 1.

As seen in FIG. 2, a delay detonator 25 possesses the following constituents:

A small tube 27 with the segments 27 and 28, an initiating composition 29, a delay composition 30 and a transmission composition 31. The last-mentioned, in the secured position pursuant to FIG. 2, is located outside of the range of response 32 for the detonator 17. The small tube 26 is displaceably supported in a sliding guide 34. A ball or spheroid 35 in the secured position of the slider 8, is supported in an aperture 36 of the slider 8. The ball 35 is supported against the sliding guide 34 and contacts against a shoulder 37 on the delay detonator 25. In the armed position of the slider 8, the aperture 36 is located outside of the housing 4. The slider 8 is equipped with a spring 40. The slider 8 possesses a center of gravity 9 at a distance 10 from the main axis 11.

Figure 3:
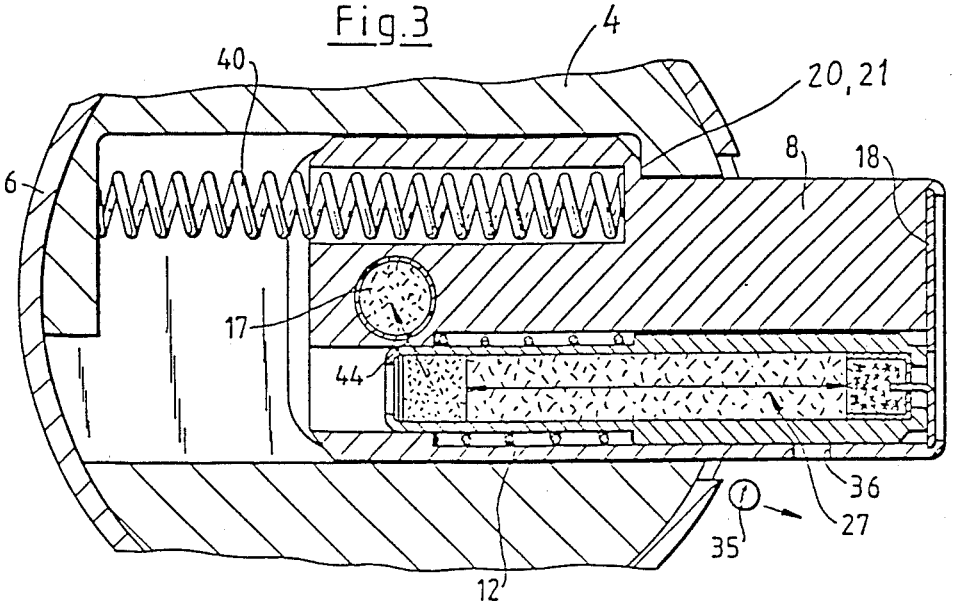
FIG. 3 illustrates the fuze of FIG. 2 in its armed position.

The bomblet 1 which is ejected from a spin-stabilized projectile also possesses a corresponding spin. A stabilizing parachute raises the striker 19 out of the bore 16 in a known manner. Thereafter, due to the centrifugal forces which are generated through the intermediary of the spin, and which forces are effective on the slider 8, and supported by the spring 40, these forces raise the slider 8 into the armed position as ascertainable in FIG. 3. As soon as the aperture is located outside of the casing or jacket 6, the ball 35 is slung out of the opening or aperture 36, and as a result, releases the delay detonator 25. The latter, due to the inertial forces, strikes against the sheet metal plate 18, as a result of which the firing pin or primer 19 initiates the triggering composition 29. It is important that the slider, during its phase of movement, will initially only convey the delay detonator 25 up to the contacting of the stop 21 against the stop 20 on the housing 4. Thereby, the delay detonator 25 is armed. Through the impact, the inertial forces act alone on the delay detonator 25, and move the latter against the sheet metal plate 18. After the passage of the combustion period of the delay composition 30, it triggers the transmission composition 31 of the detonator 17 which is located immediately adjacent the detonator 17, in conformance with the arrow 44. This then initiates the explosive charge 3 through the transmission charge 2. In the armed position (FIG. 3) the slider 8 is secured in a known manner.

The described operative sequence is effected only under the prerequisite that the bomblet 1 strikes against soft ground, so that no corresponding impulse is encountered for the striker 15.

The capability of telescoping for the delay detonator facilitates the provision of a relatively extensive constructional length, which is only limited by the extent of the approach path 50 between the primer or firing pin 19 and the triggering composition. Moreover, in the secured position, there is also present a distance or spacing which serves for ensuring safety, which is defined as the response zone 32. Hereby, when outside of the rule, the delay detonator 25 is triggered in the secured position, this will afford that the detonator will not be activated due to the spatial separation.

The hot gases and particles from the transmission composition 31 are conducted off in a discharge spaces (not shown) of the pyrotechnic fuze 5 (not shown).

Notwithstanding the capability of telescoping for the delay detonator 25, in the armed position it is afforded that the transmission composition 31 is positioned in immediate proximity to the detonator 17. The transmission composition 31 penetrates the segment 28, the wall 33 and the detonator cup 38.

For a bomblet without spin, a spring 12 causes, or supports, the arming of the delay detonator 25.

Figure 4:
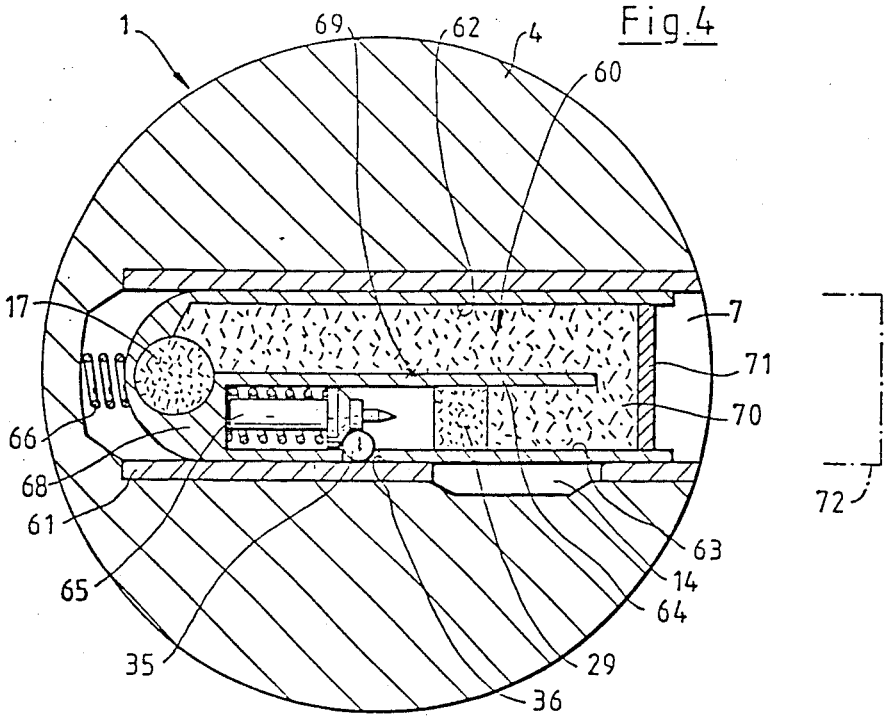
FIG. 4 illustrates a sectional view through a further embodiment of a fuze.

Pursuant to FIG. 4, a slider 68 with the eccentric center of gravity 69 is fixed in the secured position through the striker 65 which cooperates with the detonator upon the impact of the bomblet 1, as shown in FIG. 1.

The slider 68 is displaceably supported in the housing 4 intermediate guide rails 61. The housing 4 possesses a single aperture 7 for the slider 68.

In the slider 68 there are arranged the following components:

the detonator 17, two bores 62, 63 with the connector 64, a spring-actuated striker bolt 65, the triggering composition 29 and a U-shaped delay composition 70 of a pyrotechnic delay device 60 with a plate 71.

The ball 35 secures the striker bolt 65. The latter lies against the guidance 61. The guidance 61 and the housing 4 are provided with a cutout 14.

The function is as follows:

When a bomblet 1 which possesses a spin is in free-flight, and the striker bolt 65 has been retracted, then the pyrotechnic self-destruct device is set into operation as follows:

The centrifugal forces move the slider 68 into the position 72 which is secured in a known manner.

The ball 35 falls into the cutout 14 and thereby releases the striker bolt 65, which triggers the triggering composition 29. After the pregiven combustion period of the delay composition 70, the latter triggers the detonator 17. This detonator then initiates the explosive charge (not shown) of the bomblet 1.

Advantageous is the extensive constructional length of the delay composition 70 by means of which there can be realized the relatively extremely lengthy combustion periods. The easy and readily surveillable manipulatability of the slider 68 is imparted thereto by the integrated units which have already been described with regard to FIG. 3; in essence, namely the striker bolt 65, pyrotechnic delay device and detonator 17.

In a bomblet without any spin, a spring 66 causes the arming of the slider 68 inclusive of the triggering function of the striker bolt 65.

What is claimed is:

1. A pyrotechnic self-destruct fuze for projectiles, rockets, bomblets and mines, comprising a housing; triggering means for a pyrotechnic delay installation in said housing consisting of a triggering composition in a delay composition; a detonator for the triggering of an explosive charge and a striker for the detonator, said detonator being arranged in a transversely movable slider, and said housing having a side aperture for the slider which is displaceable outwardly beyond the external housing contour, and which slider contains the delay installation; wherein the slider includes two bores which extend parallel and which are only connected in a U-shape at one end of the slider in the plane of movement of the slider, said bores containing the triggering means and the pyrotechnic delay installation.

2. A pyrotechnic self-destruct fuze as claimed in claim 1, wherein the delay installation in the slider is supported so as to be longitudinally displaceable; securing means for fastening the delay installation in the slider and unlatching the installation in only the armed position of the slider, and said slider includes a stationary firing pin for said displaceable delay installation.

3. A pyrotechnic self-destruct fuze as claimed in claim 1, wherein the securing means for the delay installation includes a ball latch, the ball in the secured position of the slider being supported in an aperture of the slider, and the slider is supported through a sliding guide and a shoulder when the aperture is proximate the contour of the housing.

4. A pyrotechnic self-destruct fuze as claimed in claim 1, wherein a narrow tube includes a transfer composition, a delay composition and a detonative triggering composition, said transfer composition in the secured position being located outside of the region of response for the detonator.

5. A pyrotechnic self-destruct fuze as claimed in claim 1, wherein the slider is fixed through spring force or through centrifugal force in a secured position through a form-fitted striker means which is supported in the main axis of the fuze, and the slider is movable subsequent to unlatching from a safe position into an armed position.

6. A pyrotechnic self-destruct fuze as claimed in claim 1, wherein the pyrotechnic delay composition is constructed U-shaped and the free end thereof contacts the detonator in the slider at generally the end surface thereof.

* * * * *